US005499521A

United States Patent [19]

Luikart et al.

[11] Patent Number: 5,499,521

[45] Date of Patent: Mar. 19, 1996

[54] TUBE BENDER APPARATUS

[75] Inventors: Myron E. Luikart, Chagrin Falls; Edward A. Pezak, Solon; Howard C. B. Kuhns, Aurora; Steven J. Volcansek, Garfield Heights, all of Ohio

[73] Assignee: Crawford Fitting Company, Solon, Ohio

[21] Appl. No.: 207,913

[22] Filed: Mar. 8, 1994

[51] Int. Cl.[6] ..... B21D 7/04; B21D 7/02

[52] U.S. Cl. ..... 72/157; 72/149; 72/173; 72/158

[58] Field of Search ..... 72/149, 157, 173, 72/369, 158, 217, 219, 387, 388

[56] References Cited

U.S. PATENT DOCUMENTS

| | | | |
|---|---|---|---|
| 643,760 | 2/1900 | Brinkman . | |
| 682,671 | 9/1901 | Condon . | |
| 749,029 | 1/1904 | Condon . | |
| 811,516 | 1/1906 | Mull . | |
| 1,052,069 | 2/1913 | Lassiter . | |
| 1,401,394 | 12/1921 | Curtis . | |
| 1,824,026 | 9/1931 | Little | 72/219 |
| 3,240,048 | 3/1966 | Callendar . | |
| 3,555,868 | 1/1971 | Hagemeyer . | |
| 3,921,424 | 11/1975 | Pearson . | |
| 3,949,584 | 4/1976 | Pearson et al. . | |
| 3,987,656 | 10/1976 | Evenson . | |
| 4,537,052 | 8/1985 | Adleman . | |
| 4,546,632 | 10/1985 | Van Den Kieboom et al. . | |
| 4,568,864 | 2/1986 | Gisske . | |
| 4,724,695 | 2/1988 | Stoehr | 72/226 |
| 4,765,168 | 8/1988 | Stange et al. . | |
| 4,926,672 | 5/1990 | Swanson | 72/157 |
| 5,226,305 | 7/1993 | Adleman et al. | 72/157 |

*Primary Examiner*—Lowell A. Larson
*Assistant Examiner*—Rodney A. Butler
*Attorney, Agent, or Firm*—Fay, Sharpe, Beall, Fagan, Minnich & McKee

[57] ABSTRACT

Apparatus intended for bending heavy through thin wall pipe and tubing includes a generally circular bending shoe mounted for rotation about a first axis and having a plurality of semi-circular concave grooves in its outer surface. The grooves are of differing sizes and located in side-by-side axial spaced planes perpendicular to the first axis. A separate pair of bending rollers is provided for cooperation with each separate concave groove. Each pair of rollers includes a first roller and a second roller having concave exterior grooves and mounted on a bracket for independent rotary movement about separate second and third axes. A support arm is joined to the bracket for permitting tilting movement of the bracket relative to the support arm about a fourth axis parallel to the second and third axes. Carrying the support arms to position the cooperating roller pairs adjacent the associated groove of the bending shoe is an adjustable frame assembly, the frame assembly including supports for permitting rapid telescopic insertion and removal of the support arms from the frame assembly for selective use of separate ones of the plurality of grooves in the outer surface of the bending shoe. Preferably, the roller sets having rolls with surfaces contoured to eliminate flattening of the tubes during bending.

8 Claims, 5 Drawing Sheets

TUBE BENDER APPARATUS

BACKGROUND OF THE INVENTION

The subject invention is directed to the art of metal bending and, more particularly, to an improved apparatus for bending metal tubes and pipes.

The invention is particularly suited for bending large diameter, thin through thick-walled pipes and tubes and will be described with reference thereto. As will become apparent, however, the invention has unique attributes for incorporation in a variety of tube bending machines used for many different types and sizes of tubular goods.

The bending of pipes and tubes using a rotatably mounted, drum-type bending shoe and cooperating support rollers is well known and has been an accepted and widely used method of tube bending for a significant period of time. A bending apparatus of this general type is shown and described in U.S. Pat. No. 3,949,584, issued Apr. 13, 1976 and entitled "Bending Apparatus Having a Roller Support Unit for E.M.T., Conduit and Thin Walled Tubing".

Typically, tube bending apparatus of this type has been used for lighter walled tubing and conduit but has not been particularly adapted for heavy-walled, large diameter pipe and tubes. Additionally, with benders of the type under consideration, it has been difficult to bend heavy-walled pipes and tubes without causing the tube cross section in the area of the bend to assume an oval or flattened shape. Machines used for field bending of thin-walled tubing, likewise, often produce a "wrinkled" distortion in the area of the bend. Moreover, it has been difficult to control and precisely produce a bend of a desired angle. The need for such a bender capable of handling heavy through thin-walled tubes has been an ongoing problem.

SUMMARY OF THE INVENTION

The subject invention provides a tube bending apparatus of the general type described which can produce precise bends in relatively heavy-walled tubing and can produce the bends without causing the tubes to assume an oval cross section. Further, apparatus of the invention can bend thin-walled tubes with minimal cross-sectional distortion without the aid of internal tube supports (e.g., mandrels or sand). In addition, apparatus formed in accordance with the invention is relatively simple to use and can quickly be adjusted for bending tubing of a variety of different diameters.

In particular, and in accordance with one aspect of the invention, there is provided an apparatus for bending relatively heavy-walled tubing, pipe, and similar tubular conduits which comprises a generally circular bending reel or drum mounted for rotation about a first axis and having a plurality of semi-circular, concave grooves in the outer surfaces thereof. The grooves are of differing sizes and located in side-by-side axially spaced planes perpendicular to the first axis. Separate pairs or sets of tubing support rollers are provided for cooperation with each separate concave groove. Each set of rollers includes a first and second roller having concave exterior grooves and mounted on a bracket for independent rotary movement about separate second and third axis. A support arm is joined to the bracket and permits tilting movement of the bracket relative to the support arm about a fourth axis parallel to the second and third axis. A frame assembly is provided for carrying the support arms to position the cooperating roller pairs adjacent the associated groove of the bending shoe. The frame assembly includes means for permitting rapid, telescopic insertion and removal of the support arms from the frame assembly for selective use of separate ones of the plurality of grooves in the outer surface of the bending drum.

Preferably, the bending drum includes at least two axially spaced, concave grooves and, alternatively, each of the two axially spaced, concave grooves has a correspondingly arranged second groove of a slightly different size located in the same plane of rotation but spaced on the opposite side of the first axis.

Preferably, and in accordance with a more limited aspect of the invention, the frame assembly is provided with means for simultaneously carrying at least two of the support arms in side-by-side relationship spaced axially along the first axis.

In the preferred embodiment of the invention, the roller pairs are arranged so that each of the rollers in the pair have a slightly different, concave exterior groove configuration designed so that as the tubing or pipe being bent passes thereover, the bend takes place in a manner such that the tubing is prevented from assuming any degree of ovality.

In addition to the above, it is preferred to have the support arms arranged with means that prevent the use of the improper support arm with the associated groove. In this regard, the roller support preferably is provided with openings into which the support arms are telescopically received and means are located within the openings to assure proper orientation of the roller pair. Concurrently, the special axial configuration precludes operation of the wrong roller pair as well.

As can be seen from the foregoing, the primary object of the subject invention is the provision of a portable rolling die apparatus for bending tube, pipe, and conduit using rolling dies with multiple curvatures in a self-compensating die pressure regulating scheme which applies increased pinch to the dies when the torque of the bend increases.

A further object is the provision of a roller and bending drum type tube bending apparatus wherein it is possible to quickly change the apparatus to adapt to the particular type and size of tube to be bent.

Another object of the invention is the provision of an apparatus of the general type described wherein changeover between tubing sizes can take place rapidly and in a manner which prevents the use of the improper combination of drum groove and roller pair.

A still further object is the provision of an apparatus of the general type described which is simple to operate and that can produce closely controlled bend angles.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
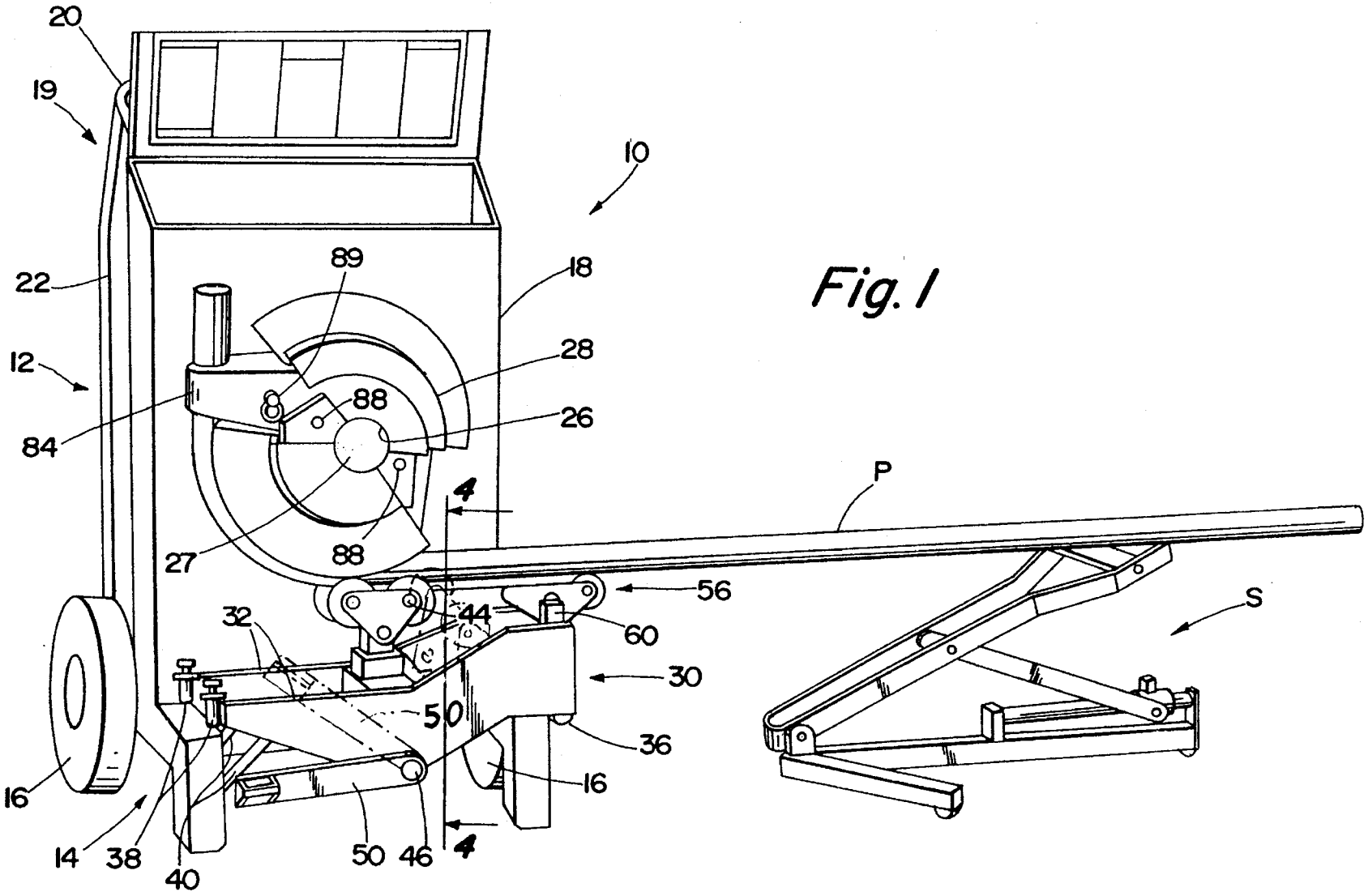
FIG. 1 is a pictorial front elevational view of a tube bending apparatus formed in accordance with the subject invention and showing it is the process of forming a bend in large diameter and thick walled tubing.
Figure 3:
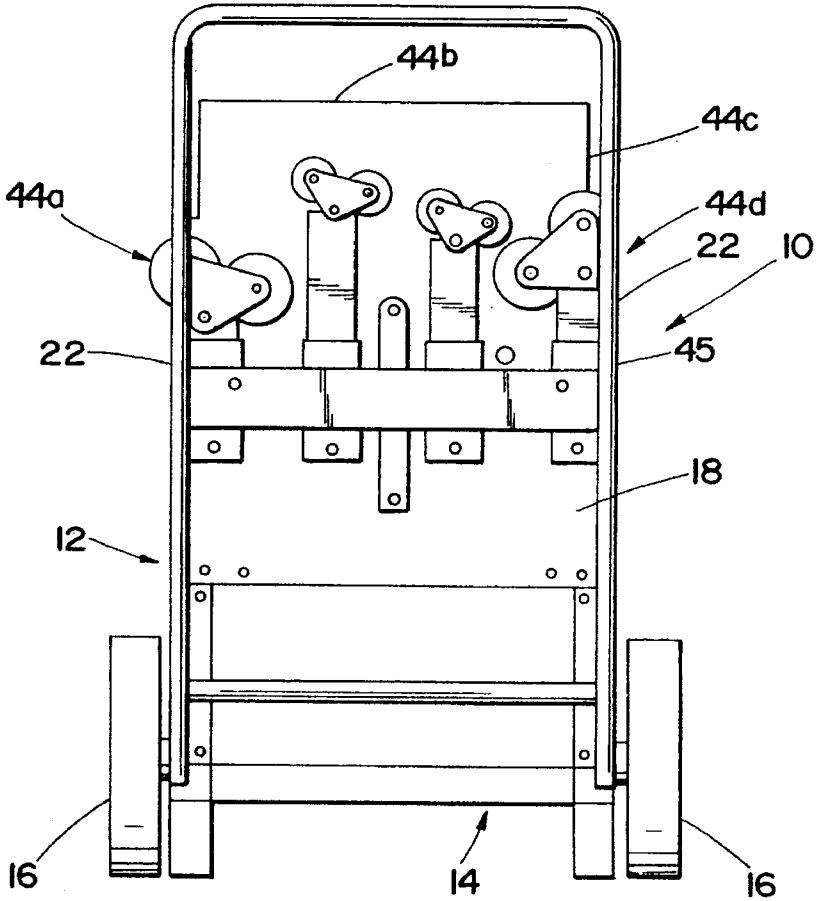
FIG. 3 is a rear elevational view of the apparatus shown in FIG. 1.
Figure 2:
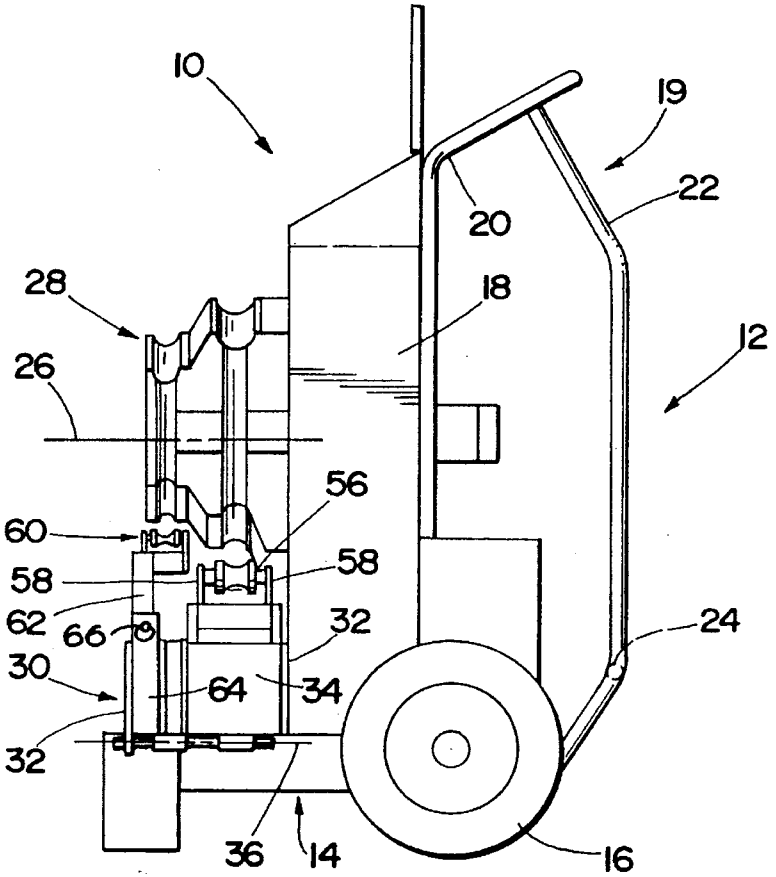
FIG. 2 is a side elevational view of the apparatus shown in FIG. 1.

Referring more particularly to the drawings wherein the showings are for the purpose of illustrating a preferred embodiment of the invention and not for the purpose of limiting same, FIGS. 1 through 3 best illustrate the overall arrangement of the subject tube bending apparatus. As illustrated therein, the preferred form of apparatus 10 generally comprises a main frame and housing assembly 12 including a tubular base frame 14 which is provided with a pair of wheels 16 to permit ready transport of the tube bending apparatus. Extending upwardly from the base 14 is a frame and housing 18 which encloses the drive apparatus and controls as will subsequently be discussed. The frame and housing assembly 12 is further provided with a tubular base and handle assembly 19 which includes the main U-shaped handle 20 and a pair of side members 22 which join from the upper end of handle 20 to the base frame 14 as best shown in FIGS. 2 and 3. A cross brace member 24 joins the side members 22 at the lower end.

The side members 22 can, as best illustrated in FIG. 2, be used to shift the assembly from the vertical position of FIG. 2 to a horizontal position in which the entire assembly rests on the members 22 so that bending can take place with the apparatus in a horizontal orientation if desired.

Carried from the frame and housing assembly 12 for rotation about a horizontal (as viewed in FIGS. 1 and 2) axis 26 is a bending drum or reel 28. The bending drum 28 is carried on a suitable bearing assembly (not shown) and is driven by a suitable drive and control motor mounted in housing 18. The details of the motor and drive controls form no part of the subject invention. The bending drum 28 will subsequently be described in detail. For the present, however, it should be noted that the drum has four separate bending grooves or tracks and is arranged so that four different size pipes or tubes can be selectively bent.

Associated with the bending drum or reel 28 is a roller support frame 30 which comprises a pair of spaced side plates 32 and suitable cross frame members 34 at spaced locations there along. The frame 30 is mounted for pivotal movement about an axis 36 which extends parallel to axis 26. Axis 36 is defined by a suitable support shaft and bearings carried from the base frame 14. At its opposite end, the frame 30 is adjustably mounted by a pair of adjusting stop screws 38. Screws 38 allow fine adjustment of the position of frame 30 in a manner to be described. The frame 30 is continually maintained in a counterclockwise, biased position to the location shown by tension biasing springs 40.

Figure 4:
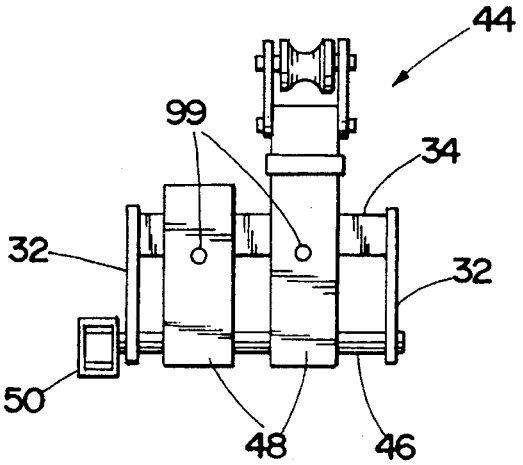
FIG. 4 is a partial cross-sectional view taken on lines 4—4 of FIG. 1.

Carried from the roller support frame 30 for cooperation with the bending reel or shoe 28 are pairs of bending roller sets 44. As can be seen in FIG. 3, the apparatus includes a number of bending roller sets 44 equal to the number of guide tracks or bending grooves on the bending reel 28. In this embodiment, there are four separate grooves so that the four separate sets of bending rolls 44 are provided. As shown in FIG. 3, the roll sets 44 have been separately identified as 44*a* through 44*d*. In this FIG. 3 showing, the roll sets are in a storage rack 45 on the back of the frame and housing assembly 12. These assemblies will subsequently be described in detail. However, for the present, referring again to FIG. 1, it will be seen that the rolls sets 44 are arranged to be supported in the roller support frame 30 and are movable between a bending position shown in solid and a non-bending roll removal position shown dotted. For this reason, the bending roll support frame 30 is arranged to carry a main cross shaft 46 which is mounted for rotation in suitable openings in the side frames 3Z and carries a rectangular tubular housing support 48. Housing support 48 is rigidly joined to the shaft 46 and provides an open upper end into which the bending roll sets 44 are adapted to be telescopically received. It will be seen in FIG. 4 that there are a pair of the tubular supports carried on the shaft 46 in side-by-side relationship. The spacing between the rectangular tubular supports 48 is arranged so that they are in alignment with separate ones of the bending grooves of the bending reel 28. This relationship will subsequently be described in some detail. For the present, it should be noted that an operating lever 50 is joined to the outer end of the shaft 46 to allow the bending roller pairs 44 to be shifted between the operative and loading or replacement positions. Also, associated with the bending reel or shoe 28 are tail rollers which support the pipe as it is moved into the bending position between the roller pairs 44 and the reel 28. There are separate tail rollers for each of the laterally spaced pairs of bending grooves on the reel 28. As best seen in FIGS. 1 and 2, a first tail roller 56 is supported at the right-hand end of the roller support frame 30 (as viewed in FIG. 1) and is carried by upwardly extending brackets 58 that are pivoted to swing from a lower position to the upper solid line position shown. In the upper solid line position, and as can be seen in FIGS. 1 and 2, the roller 56 cooperates with the larger diameter groove of the reel 28 to support the end of the pipe P at a spaced location from the bending reel and the roller pair 44. The outer periphery of the support roller 56 is concave as shown and preferably has a radius on the concave surface which is at least as large as the larger of the two grooved tracks with which it is aligned.

A second tail support roller 60 is also provided on the frame 32 to align with the other set of bending grooves. This tail roller 60 is carried at the upper end of a rectangular support post 62 that is telescopically received in a rectangular tube 64 and welded to the left-hand side frame 32 (as viewed in FIG. 2). The tube 62 is, as noted, telescopically received in the tube 64 and held in the desired position of vertical location by a removable pin 66 which passes through aligned openings in the post 62 and the tube 64. It should be noted that, as shown in FIG. 2, the roller 60 is located in alignment with the leftmost set of bending grooves on the reel 28 and has a concave outer surface of a radius at least as great as the maximum radius of the tube bending grooves with which it aligns.

Figure 5:
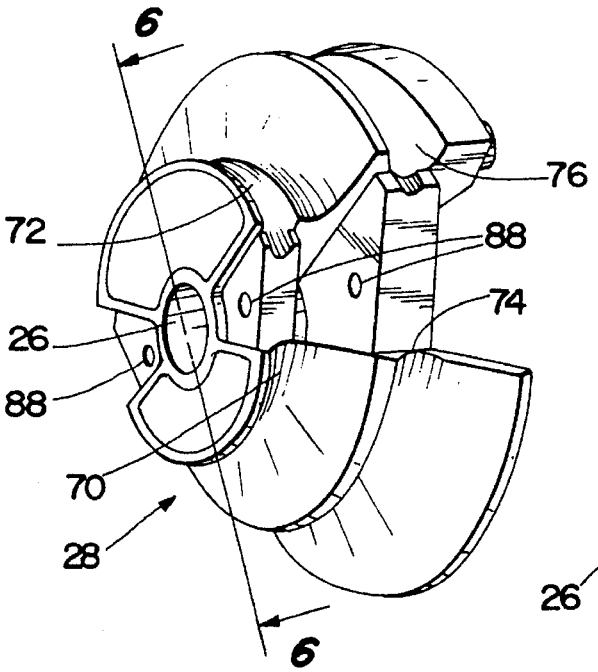
FIG. 5 is a perspective view of the bending drum of the FIG. 1 apparatus.
Figure 6:
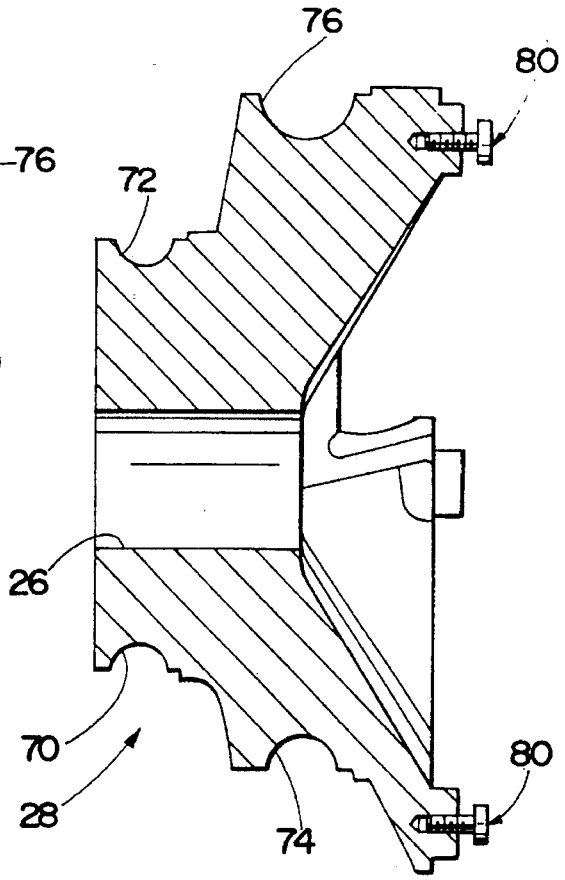
FIG. 6 is a cross-sectional view taken on lines 6—6 of FIG. 5 to more clearly show the contour of the various tube bending portions of the drum.

The main components discussed above will now be described in greater detail to specifically set forth the preferred features of each. Referring in particular to FIGS. 5 and 6, the overall arrangement and details of the preferred form for the bending drum or reel 28 can best be understood. As previously mentioned, the subject bending drum 28 is designed specifically to handle or bend four different sizes of pipe or tube. As noted early, the drum is sufficiently strong for use in bending heavy walled tubing and is formed as a one-piece structure having four separate bending grooves formed in the outer surface thereof. In particular, the bending reel 28 includes two sets of aligned bending grooves 70, 72 and 74, 76. The grooves 70 through 74 could be of any selected range of sizes, but in the preferred embodiment are respectively arranged to bend tubing of 1 inch diameter, 1–¼ inch diameter, 1–½ inch diameter, and 2 inch diameter. The grooves 70 and 72 lie in the same plane which is perpendicular to the axis of rotation 26. Each of the grooves 70, 72 extends throughout an arcuate extent of approximately 120° . Although it could differ substantially from what is shown, the radius from axis 26 of the 1 inch bending groove 70 is approximately 4 inches to the location of the tube center line. On the other hand, the 1–¼ inch bending groove 7Z is positioned at a radius such that the center line of the tube being bent in groove 72 lies approximately 5 inches from the axis 26. Similarly, the groove 74 which is used for bending 1–½ inch tubing lies outwardly from the center line or axis of rotation 26 a distance 6 inches to the center line of the tube being bent. The bending groove 76 which is in the same plane with groove 74 which plane is also perpendicular to the axis 26 lies outwardly at a radius of 8 inches to the center line of the tube. Each of the bending grooves 70, 72, 74, and 76 has a cross section which is a true circle corresponding to the normal exterior diameter of the tube to be bent. For example, the radius of a 1 inch tube is only slightly greater than 0.5 inches. The same relationship is present in the other grooves.

The bending reel 28 is, as previously mentioned, supported from a main central support axle 27 and is driven from a main chain drive sprocket (not shown) located within the housing 18 and drivingly connected with the reel 28 through a plurality of drive pins 80.

Figure 7:
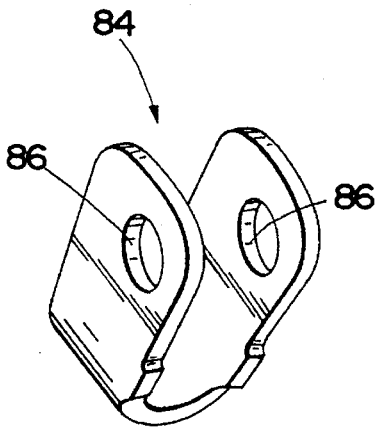
FIG. 7 is an isometric view showing a saddle clamp used with the bending drum of FIG. 5.

As best shown in FIGS. 1 and 7, a separate U-shaped tube clamp 84 is provided for association with each of the bending grooves 70, 72, 74, and 76. FIG. 7 shows a typical saddle clamp or tube clamp 84 which is provided with a pair of aligned openings 86 located in the legs of the clamp. The individual tube clamps 84 are sized such that their radius of the bight portion corresponds to the radius of the tube bending groove with which they are associated. Additionally, the lengths of the legs and the location of the openings 86 are positioned so that when installed as shown in FIG. 1, the bight portion of clamp 84 in cooperation with the associated bending groove forms a continuation thereof and in combination therewith fully encircles and clamps the tube to the bending reel 28 at the proper location for starting a bend. The legs flare outwardly about 3° from the tube centerline to prevent damage to the surface of the tube during bending. FIG. 1 shows the tube clamp 84 which is in position with the bending groove 76 for bending 2 inch diameter tubing P. FIG. 1 also shows the right distal end of the tubing P supported by an adjustable support S which forms no part of the invention but is illustrated merely to show the overall environment and apparatus used in forming bends.

It will be noted that the bending reel or drum 28 is provided with a plurality of openings 88 positioned to be aligned with the openings 86 on the U-shaped tube clamps 84. A suitable retaining pin 89 is adapted to be manually inserted and removed through the openings 86, 88 when they are in proper alignment. The tube clamps 84 can, of course, be manually installed and released with the tubing in place both before and after the bend is completed in manner subsequently to be described.

Figure 8:
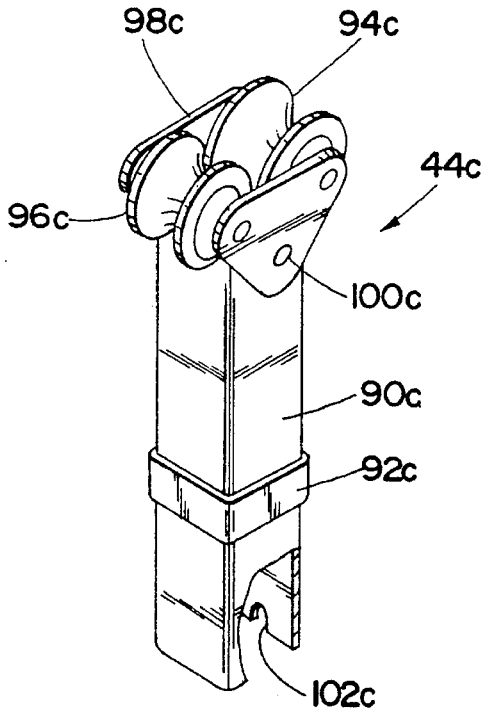
FIGS. 8 and 9 are isometric views showing roller pairs used for different tubing sizes and their mounting arrangement.
Figure 9:
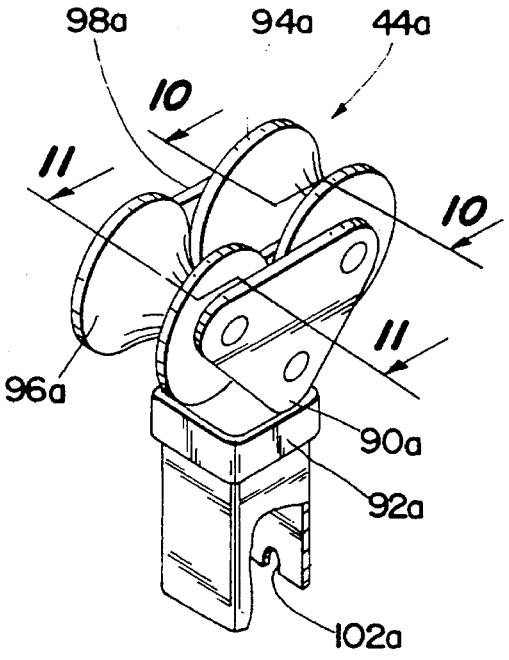

As previously mentioned, a bending roll set 44 is adapted to be associated with each of the bending grooves 70, 72, 74, and 76. The bending roll sets are received and supported by the rectangular tubular supports 48 of the roller support frame 30. FIGS. 8 and 9 show two of the bending roll sets 44. As previously noted, each bending roll set is sized and arranged to cooperated with only one of the grooves 70, 72, 74, and 76. FIGS. 8 and 9 illustrate bending roll sets **44*c* and 44*a*, respectively. Set 44*c* is arranged to be received in the outermost rectangular support tube 48 (the left tube 48 as viewed in FIG. 4) for cooperation with the outer bending groove 72 which is the 1–¼ inch bending grooves. Set 44*a* is arranged for receipt in the inner tube 48 for cooperation with groove 76 which is the 2** inch bending groove.

In their construction and design, the two bending roll sets are of generally similar construction like reference numerals differentiated by the letter prefix c or a will be used to identify the corresponding parts of each. The description of the bending roll sets **44*c* and 44*a* is generally equally applicable to roll sets 44*b* and 44*d* which are intended for the 1 inch and 1–½ inch diameter tubes, respectively. The differences will, however, become apparent to one of ordinary skill in the art. With respect to FIG. 8, it will be seen that the roll set 44*c* includes a main rectangular support post 90*c* which is arranged to be closely received in the previously mentioned tubular housing support 48. It is arranged to telescopically enter the support 48 and is limited in its inward movement by a rectangular collar 92 which is located at a vertical position such that when in position, the rollers engage with the associated guide track of the bending reel 28 so as to cooperate with and thereby hold the tubing being bent in proper position in the bending groove. With respect to the roll set 44*a*, this set cooperates with groove 72 for bending 2 inch tubing. Final adjustment of the position of the bending set 44*c*, as well as the other sets is accomplished by use of the previously mentioned screws 38 that move frame 30**.

The individual rolls **94*c* and 96*c* of roll set 44*c* are supported from the upper end of the support tube 90*c* by a pair of triangular shaped support members 98*c* which are pivotally connected to the support 90*c* by a transverse shaft or pivot pin 100*c*. The left-hand roll 96*c* (as viewed in FIG. 8) is referred to as the front roller and is in the lead or left-hand position when properly installed in the FIG. 1 showing. The right roller 94*c* (as viewed in FIG. 8) is referred to as the rear tube roller and has the right-hand position as viewed in FIG. 1 when the roller set is properly installed. To assure proper installation in the support 48, the support post 90*c* is provided with a U-shaped recess or cutout 102 in the lower edge. This cutout is arranged to cooperate with an internal pin 99 in tube 48 to prevent installation of the support post 90*c* in an improper manner. That is, it can properly seat within the tube support 48 only when it is properly oriented with the recess 102 received over the internal pin member 99**.

The various rollers (i.e., the bending roller pairs 44 and the tail roller 60) interact cooperatively to facilitate and control the bending. The bending roller pairs have a desired shape which will subsequently be described; however, for the present, it should be noted that the lead roller of the pair (i.e., the left roller as viewed in FIG. 1) is always located and positioned tangent to the drum at the same point regardless of the tube size. This aids in producing repeatability from bend to bend.

The tail support roller 60 acts to reduce the load on the bend by reducing the amount of torque which must be developed to bend a given tube size.

As will be described later, the lead roller of the pair has a special shape which works with the drum groove shape, the tube clamp 84, and the squeeze adjustment provided by the screws 38 to retain the circular cross section of the tube.

Figure 10:
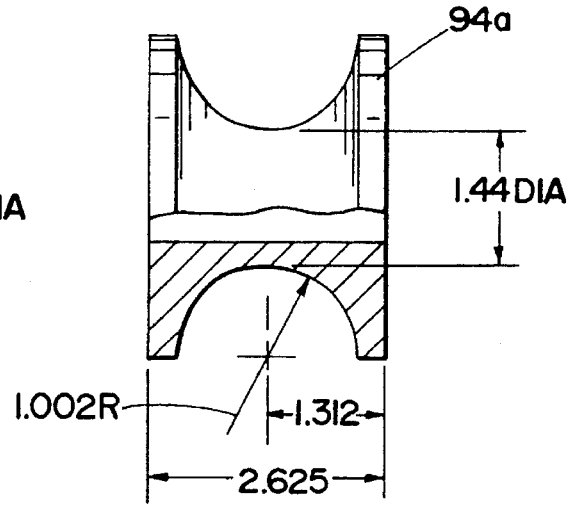

According to the subject invention, the contour of the rollers 94 and 96 is controlled in a manner which assures that the tubing is bent without producing an oval or flattened cross section. In this regard, as shown in FIG. 10, the lead in roller or rear tube roller 94*a* is provided with an outer contour which corresponds to the normal circular shape and configuration of the tube being bent. In this instance, the roller 94*a* has a circular shape of a full 1 inch radius to correspond to the external shape of the 2 inch diameter tube. This larger diameter provides additional lateral support during bend which coaxes the tube to stay of circular cross section. On the other hand, the front tube roller is provided with a cross-sectional shape best shown in FIG. 11. As shown therein, the shape of the peripheral groove on roller 96*a* is shaped so as to apply transverse lateral inwardly directed forces to the tube as it passes therethrough. These forces are applied to the tube at the point the bend begins and act to prevent the tube from being flattened as it passes through the main bending point. In particular, the radius $R_1$ is less than the normal one-half radius of a 2 inch diameter tube. The continuation radius $R_2$ is positioned about a center point which is offset from the center point radius $R_1$. It is arranged so that the actual resulting full width in the widest part of the groove 96*a* is slightly less than the full diameter of a normal unbent tube. This loading of the tube cross section during the bending operation results in a final configuration following the bending step which is nearly a perfect circle without any flattening of the tube or other resulting loss of its true circular shape.

Figure 11:
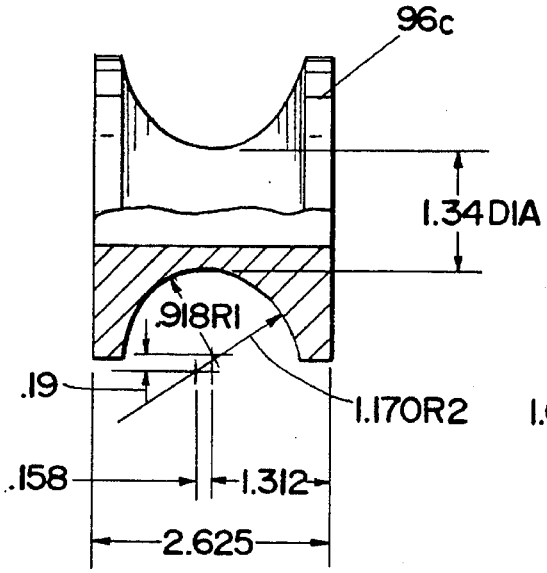
FIGS. 10 and 11 are cross-sectional views taken on lines 10—10 and 11—11 respectively of FIG. 9.
Figure 12:
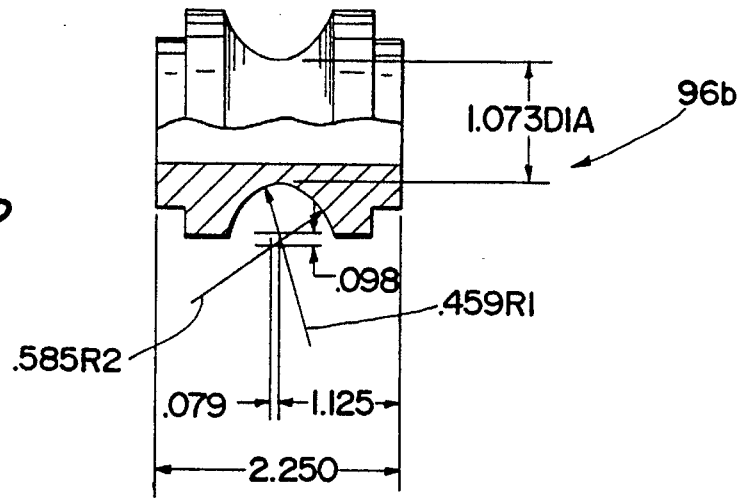
FIGS. 12, 13, and 14 are views like FIG. 11 but showing rolls intended for other tubing sizes.
Figure 13:
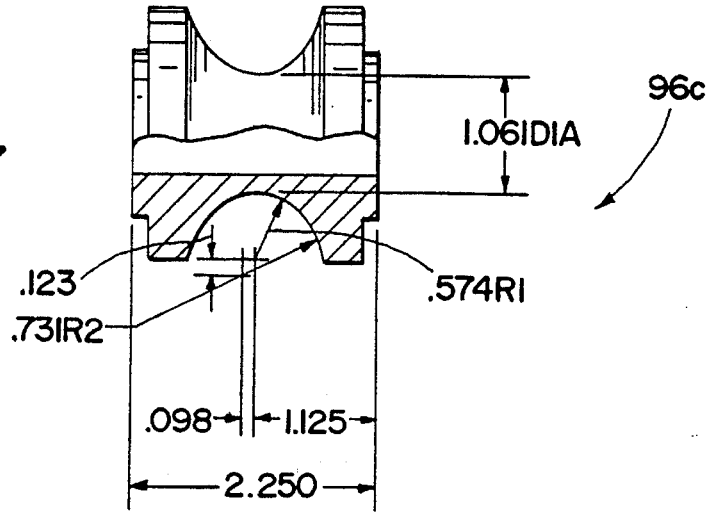
Figure 14:
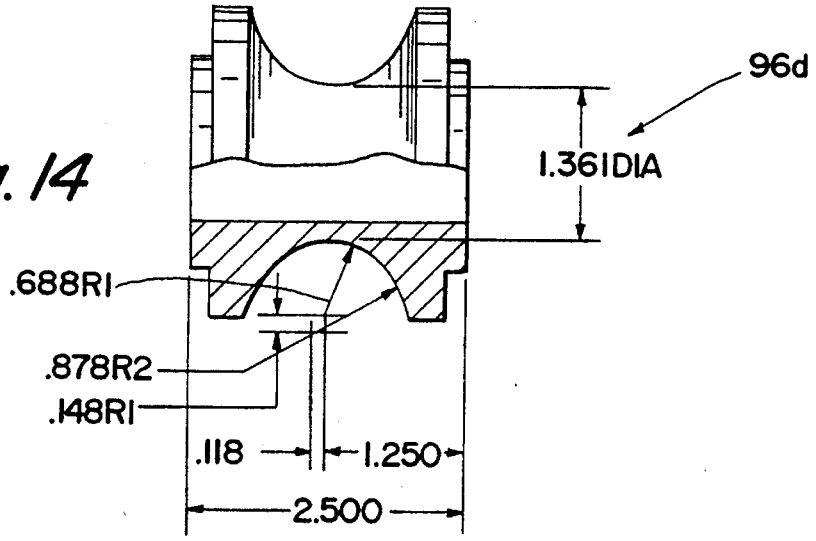

FIGS. 12, 13, and 14 are like FIG. 11 but show the front rollers 96*b*, 96*c*, and 96*d* which are respectively for the 1 inch, 1–¼ inch, and 1–½ inch bending roll sets. In each of these, the bending groove has the reduced width to produce the non-oval bend cross section.

As can be seen from the forgoing, the invention provides apparatus that allows safe compact inexpensively tooled, and easy to use on-site bending of a wide range of wall thickness tube, pipe, and conduit at tight bend radius with otherwise unavailable accuracy in a circular cross section both surrounding and along the bend.

The apparatus provides improved accuracy in a circular cross section with significant reduction or elimination of variations along the axis of the centerline of the tube, pipe, or conduit (commonly called "wrinkling" caused by interior wall instability or buckling).

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. Apparatus for bending tube, pipe, and conduit comprising:

a generally circular bending shoe mounted for rotation about a first axis and having a plurality of semi-circular concave grooves in the outer surface thereof, the grooves being of differing sizes and located in side-by-side axial spaced planes perpendicular to the first axis;

a separate pair of rollers for cooperation with each separate concave groove, each pair of rollers including a first roller and a second roller having concave exterior grooves and mounted on a bracket for independent rotary movement about separate second and third axes;

a support arm joined to said bracket for permitting tilting movement of the bracket relative to the support arm about a fourth axis parallel to the second and third axes; and, a frame assembly for carrying the support arms to position the cooperating roller pairs adjacent the associated groove of the bending shoe, the frame assembly including means for permitting rapid telescopic insertion and removal of the support arms from the frame assembly for selective use of separate ones of the plurality of grooves in the outer surface of the bending shoe.

2. Apparatus as defined in claim 1 wherein the bending shoe includes at least two axially spaced concave grooves.

3. Apparatus as defined in claim 1 wherein the frame assembly includes means for simultaneously carrying at least two support arms in side-by-side relationship spaced axially along the first axis.

4. An apparatus for bending pipe or tubular conduit and comprising:

a bending shoe, including a generally circular member mounted for rotation about a central axis and having a plurality of circumferentially and axially spaced external concave grooves of differing sizes;

roller means for cooperating with the bending shoe for bending pipe or conduit in said grooves, said roller means comprising plural sets of roller pairs selectively usable with separate ones of the external concave grooves of the bending shoe, each set of roller pairs being carried on a separate support arm; and, a frame assembly for carrying the support arms to position the sets of rollers in operative position adjacent the respective associated groove of the bending shoe, the frame assembly including arm support means including means for telescopically receiving the support arms for permitting rapid selective manual insertion and removal of the support arms from the frame assembly.

5. The apparatus as defined in claim 4 wherein the arm support means includes means for simultaneous supporting at least two of the support arms in sided-by-side operative relationship relative to the bending shoe.

6. The apparatus as defined in claim 4 wherein the bending shoe includes U-shaped saddle means for retaining the pipe being bent in alignment with the selected groove, the U-shaped saddle means being releasably connected to the bending shoe by pin members.

7. An apparatus for bending pipe or tubular conduit comprising:

a bending shoe mounted for rotation about a first axis and having a plurality of separately usable bending grooves of different sizes formed in the exterior thereof;

a roller support unit associated with the bending shoe for supporting roller pairs adjacent the bending to cooperate with the bending grooves to maintain the pipe or conduit being bent in engagement therewith;

a plurality of roller pairs adapted for selective interchangeable receipt in the roller support unit, each roller pair mounted in common on a separate support arm with the support arms including locating means for limiting the location at which the arms can be positioned in the roller support unit to thereby require the proper size roller pair to be properly positioned relative to the bending shoe groove with which it is to be used;

the roller support being provided with openings into which the support arms can be telescopically received with the locating means limiting the distance the support arms can be inserted into the openings.

8. Apparatus as defined in claim 7 wherein each roller pair comprises rollers having grooved exterior surfaces with each roller in a pair having a differently configured groove than the other roller in the same pair.

* * * * *